US005160406A

United States Patent [19]

Lucca et al.

[11] Patent Number: 5,160,406

[45] Date of Patent: Nov. 3, 1992

[54] METHOD FOR PRODUCING A FORMED STRUCTURAL ELEMENT

[75] Inventors: Eusebio Lucca, Vercelli; Paul H. Gillard, Roccatederighi, both of Italy

[73] Assignee: Matec Holding AG, Switzerland

[21] Appl. No.: 509,228

[22] Filed: Apr. 16, 1990

[30] Foreign Application Priority Data

Apr. 14, 1989 [CH] Switzerland ..... 1425/89

[51] Int. Cl.[5] ..... B27N 3/12; B29C 51/10; B02C 18/00; B32B 31/16

[52] U.S. Cl. ..... 156/62.4; 156/245; 156/256; 156/283; 156/285; 156/296; 264/116; 264/118; 264/125; 264/140; 83/913; 425/83.1

[58] Field of Search ..... 156/62.2, 62.4, 62.6, 156/245, 256, 264, 270, 283, 285, 296, 512, 538; 264/115, 116, 118, 121, 123, 125, 152, 140; 425/412, 82.1, 83.1; 83/913

[56] References Cited

U.S. PATENT DOCUMENTS

| | | | |
|---|---|---|---|
| 2,745,491 | 5/1956 | Sonneborn et al. | 83/913 |
| 2,890,146 | 6/1959 | Unsworth | 156/62.8 |
| 3,873,290 | 3/1975 | Marzocchi | 83/913 |
| 4,043,779 | 8/1977 | Schaefer | 83/913 |
| 4,097,965 | 7/1978 | Gotchel et al. | 156/62.4 |
| 4,153,488 | 5/1979 | Wiegand | 156/62.2 |
| 4,483,727 | 11/1984 | Eckmana et al. | 83/913 |
| 4,623,499 | 11/1986 | Fuma et al. | 264/123 |
| 4,650,538 | 3/1987 | Simmonds et al. | 156/283 |
| 4,761,258 | 8/1988 | Enloe | 264/118 |
| 4,931,243 | 6/1990 | Henschel et al. | 264/121 |

FOREIGN PATENT DOCUMENTS

| | | | |
|---|---|---|---|
| 0232140 | 12/1959 | Australia | 425/83.1 |
| 1303588 | 5/1962 | Fed. Rep. of Germany . | |
| 1635615 | 8/1974 | Fed. Rep. of Germany . | |
| 2357675 | 2/1978 | France . | |
| 2439082 | 5/1980 | France . | |
| 2537495 | 6/1984 | France | 425/412 |
| 8904886 | 6/1989 | PCT Int'l Appl. | 156/296 |
| 1602701 | 11/1981 | United Kingdom | 264/116 |

*Primary Examiner*—Michael W. Ball
*Assistant Examiner*—Nancy T. Krawczyk
*Attorney, Agent, or Firm*—Wigman & Cohen

[57] ABSTRACT

The present invention relates to a method and apparatus for producing a formed structural element of fiber material bonded with synthetic resin such that a fine-grained or flowable synthetic resin bonding agent is sprinkled on or sprayed on a nonwoven fabric made entirely or predominantly of natural fibers. The nonwoven fabric which is permeated with synthetic bonding agent is fragmented, whereupon the parts are stored in a tower on a perforated female mold which belongs to a molding press and are precompressed on the female mold by means of an air stream that is suctioned through the perforations. To produce formed structural elements with a stable shape, the synthetic resin bonding agent, after a similarly perforated male mold has been placed on top and pressed on, is hardened by means of a hot air stream that is conducted through the perforations in the male mold and the female mold.

5 Claims, 2 Drawing Sheets

METHOD FOR PRODUCING A FORMED STRUCTURAL ELEMENT

BACKGROUND OF THE INVENTION

1. Field of the Invention

The present invention relates to a method and apparatus for producing a formed structural element of fiber material bonded with synthetic resin such that a fine-grained or flowable synthetic resin bonding agent is sprinkled on or sprayed on a nonwoven fabric made entirely or predominantly of natural fibers. The nonwoven fabric which is permeated with synthetic bonding agent is fragmented, whereupon the parts are stored in a tower on a perforated female mold which belongs to a molding press and are precompressed on the female mold by means of an air stream that is suctioned through the perforations. To produce formed structural elements with a stable shape, the synthetic resin bonding agent, after a similarly perforated male mold has been placed on top and pressed on, is hardened by means of a hot air stream that is conducted through the perforations in the male mold and the female mold.

2. Description of the Prior Art

A method of the type described above is known, for example, from the FR-patent specification 76-20950 (publication No. 2 357 675). This method makes it possible to produce structural elements which exhibit a good cushioning effect, sound absorption, and heat insulation, and which therefore are used preferably for the inside lining of vehicle compartments. The method also makes it possible to produce structural elements with a prescribed outline and in this fashion to avoid material losses caused by cutting to size, losses which, for the above-mentioned application, according to experience amount to about 30% on the average.

A disadvantage of this known method is that sound absorption, which is especially important for the described application as an inside lining of vehicle compartments, practically cannot be optimized. It is possible for the parts or fibers of the nonwoven fabric and the fine-grained synthetic resin bonding agent to separate when they are stored in the tower, so that the stored parts of the nonwoven fabric or fibers contain different amounts of synthetic resin bonding agent depending on their location. When the synthetic resin bonding agent is hardened, this leads to areas with different bonding between the parts of the nonwoven fabric and fibers. As a result, the elasticity and the sound absorption depending on it will differ depending on location. With the known methods, a deposit necessarily has a thickness that is practically constant over its entire surface. If structural elements with a relief-like shape are produced from such a deposit, with a thickness that varies according to location, then the deposit must be compared to a different degree in correspondence with the location. This variably strong compaction creates regions with a different material density, which again leads to regions with different elastic modulus and thus also different sound absorption.

OBJECTS AND SUMMARY OF THE INVENTION

It is therefore an object of the present invention to provide a method for producing a formed structural element for which separation of fiber parts or fibers and synthetic resin bonding agent is practically impossible, and which also makes it possible to produce a structural element with a relief-like shape and with a thickness that differs by location, but with a material density that is practically uniform in all areas.

According to the present invention, this object is achieved by a method of the type mentioned in the introduction, wherein synthetic resin bonding agent is prehardened after it has been sprinkled on or sprayed on and before the nonwoven fiber fabric has been fragmented, and wherein the nonwoven fiber fabric that is bonded with the prehardened synthetic resin bonding agent is divided into fiber bundles or flakes before being introduced into the tower.

The inventive method makes it possible to deposit fiber material with a large area and with practically uniform thickness and with a likewise uniform distribution of the synthetic resin bonding agent.

In a preferred embodiment of the method, structural elements are produced with areas of different thickness and with a material density that is uniform in all the areas. Here, the flakes of the fragmented nonwoven fiber fabric are deposited to form a deposit with a thickness that differs by areas.

This preferred method of the present invention makes it possible to produce structural elements with a relief-like shape and with a different thickness and with a material density that is practically uniform in all regions. This can be done with an appropriately designed female mold and/or male mold. In a structural element that is made of fiber material bonded with synthetic resin, the material density influences the through-flow resistance for air and the elastic modulus, which again are determining factors for sound absorption and sound insulation. Consequently, this embodiment of the method makes it possible to produce structural elements with a thickness that differs by regions and with a sound absorption and insulation that is equally optimized in all regions.

A preferred apparatus of the present invention comprises: a fiber magazine and a loading device which loads the fibers on a transport belt to form the nonwoven fabric; a sprinkling or spraying device which sprinkles or sprays an appropriately prepared synthetic resin bonding agent on the nonwoven fabric; a transport device which conducts the nonwoven fabric that is permeated with synthetic resin bonding agent to a willowing drum, whose outlet is connected to the inlet opening of a tower to deposit the parts of the fragmented nonwoven fiber fabric; a female mold which is disposed below or at the lower end of the tower to deposit the parts; as well as a male mold which is provided to be placed upon the female mold that is loaded with the parts; the female mold and the male mold having perforations, where the perforations of the female mold are equipped with a source of vacuum when the parts are being deposited, while the perforations of the male mold are provided to introduce a hot air stream after the male mold has been placed upon the female mold, wherein a device for preheating the synthetic resin bonding agent is disposed between the device for sprinkling on or spraying on the synthetic resin bonding agent and the willowing drum, and wherein the willowing drum is adjusted to tear up into fiber bundles or into flakes the nonwoven fiber fabric that has been bonded with the prehardened synthetic resin bonding agent.

BRIEF DESCRIPTION OF THE DRAWINGS

The method and apparatus according to the present invention are described below by means of the drawings wherein.

DETAILED DESCRIPTION OF THE PREFERRED EMBODIMENTS

Figure 1:
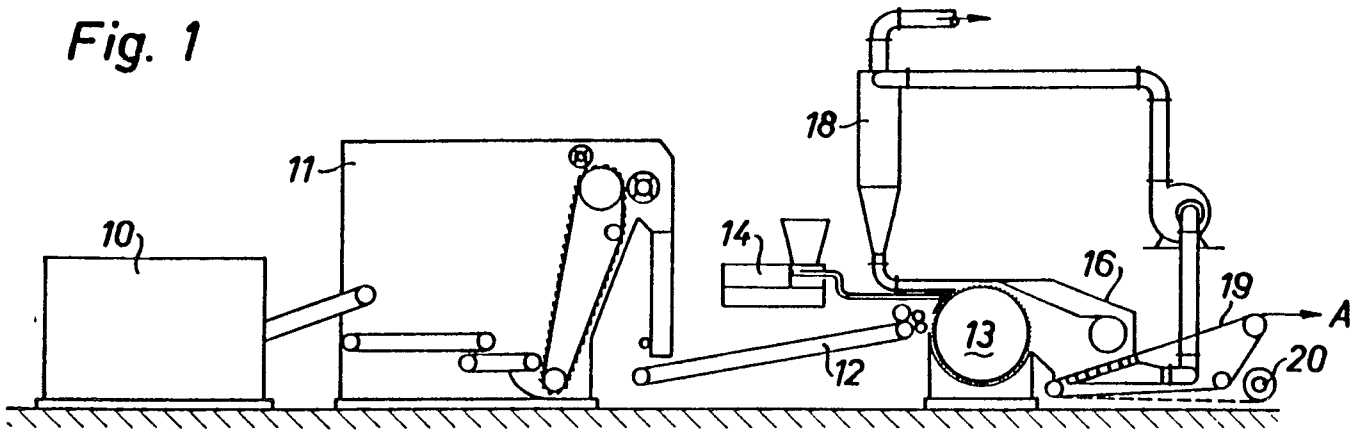
FIGS. 1 and 2 are schematic diagrams showing apparatus according to the present invention.
Figure 2:
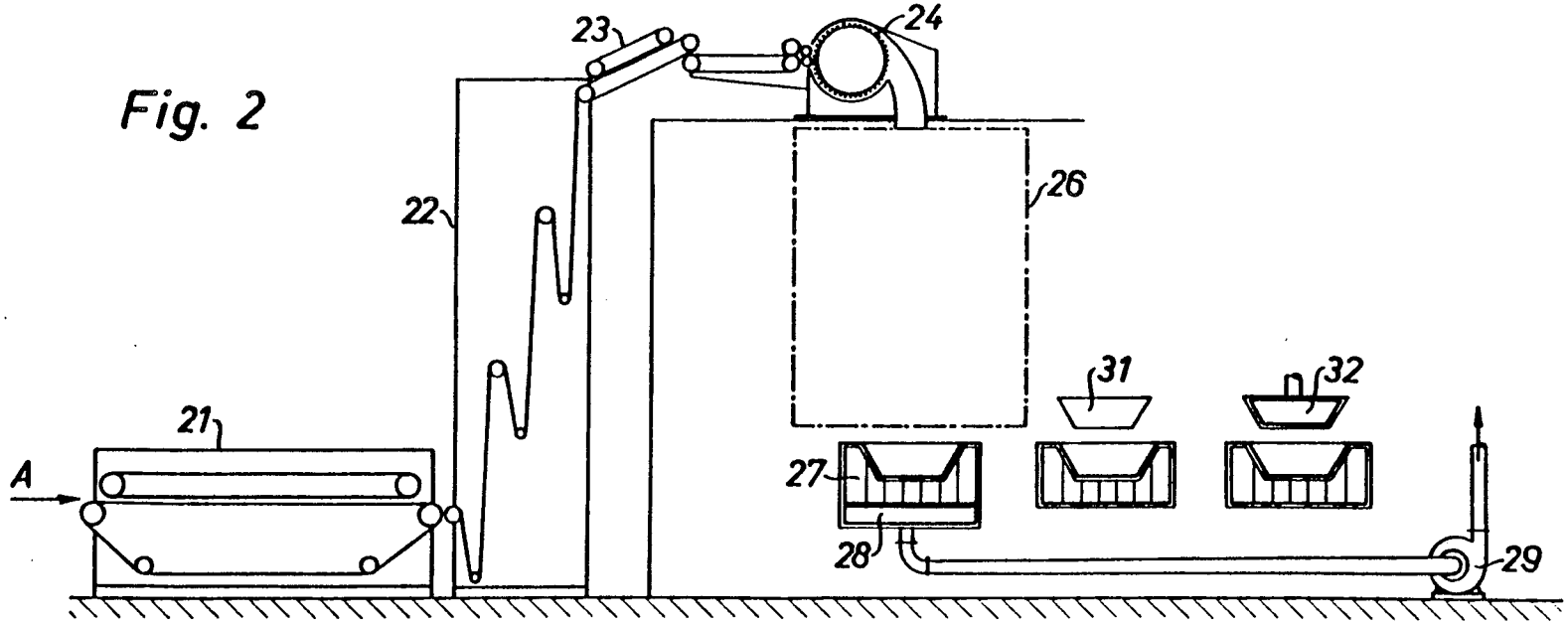

An apparatus suited to implement the inventive method is shown schematically in FIGS. 1 and 2. This apparatus contains a magazine 10 for the fibers that are to be processed. A loading device 11 associated with the magazine includes several transport belts and an impeller wheel, which deposits the fed-in fibers through a shaft onto the supply belt 12 of a carding machine 13. A dosing device 14 is provided with a storage container for fine-grained thermosetting hardenable material that is suited as a synthetic resin bonding agent, and with a transport worm for conducting doses of this material into the region of a carding machine inlet. The carding machine 13 is enclosed in a housing 16. A first blower 17 is provided which suctions air from the region of the carding machine outlet, and which is connected via a pipeline to a cyclone 18, whose outlet leads to the inlet of the carding machine. Another transport belt 19 is disposed at the outlet of the carding machine. This transport belt transports the nonwoven fiber fabric, which is taken from the carding machine and which is permeated by the fine-grained, thermosetting resinous material, to a through-type furnace 21 (FIG. 2). The transport belt runs past a supply roll 20, which carries a coil made of a nonwoven textile composite material, with which the transport belt is loaded as it runs past. A magazine 22 with deflection rolls that are movable in the vertical direction is set up adjoining the exit of the through-type furnace. Two circulating transport belts 23, with a friction interlock, are disposed at the outlet of the magazine. The nonwoven fiber fabric is grasped between these transport belts and is conducted forwards to the entry of a willow machine 24. The willow machine is disposed above a scrubber tower 26. A support 28, suited for setting up a female mold 27, is fastened at the lower end of the scrubbing tower. The upper side of the support 28, which is provided for setting up the female mold, has holes which lead into a cavity which is connected via a pipeline to a second blower 29.

When the described apparatus is in operation, the fiber magazine 10 is filled with textile fibers and preferably with reclaimed wool, which has been obtained by shredding textile wastes from spinning mills, weaving mills, knitting mills, tailor shops, and households. The fibers from the loading device 11 which come from the magazine 10 are sprinkled on the feed belt 12 by the impeller wheel and the downshaft. The fibers are then carried to the carding machine 13.

The outlet of the dosing device 14 for the fine-grained, thermosetting resinous material ends in the neighborhood of the inlet to the carding machine. The fine-grained, thermosetting resinous material is sprinkled onto the nonwoven fiber fabric which is to be formed in the carding machine. After being removed from the carding machine, the nonwoven fiber fabric is transferred to another transport belt 19, which is loaded with the textile composite material. This transport belt conducts the nonwoven fabric to the entrance of the furnace 21. The blower 17 suctions into its suction opening the air from the environment of the carding machine and, along with this, also that part of the fine-grained material that was not deposited in the nonwoven fiber fabric, or which falls out of the nonwoven fabric while the carding machine is rotating or while the nonwoven fabric is being transferred from the carding machine to the transport path. The blower transports this suctioned air and the fine-grained material to the cyclone 18, where the material is separated from the air and is again recycled to the outlet of the dosing device. In the through-type furnace 21, the nonwoven fabric with the material deposited in it is heated to a medium temperature, at which the thermosetting resinous material is softened, and the fibers of the nonwoven fabric are glued together and with the textile composite material, without polymerizing or hardening.

The nonwoven fabric with the glued-together fibers is then pulled into the magazine 22, where it is cooled and where the fine-grained material, that was previously softened in the furnace, is again rigidified, and where differences in the pull-through rate of the nonwoven fabric are simultaneously compensated. In the willow machine, the nonwoven fabric, together with the textile composite material, is opened again. For this purpose, the willow machine is adjusted in such a fashion that no individual fibers result, but instead, fiber bundles or flakes consisting of glued-together fibers are formed. The fiber bundles fall to the bottom of tower 26 under the action of their own weight and the weak air stream generated by the blower 29. In this way, they form a homogeneous deposit on the female mold 27. This deposit is slightly compacted by the air that is suctioned through the holes in the female mold.

As soon as a sufficiently thick deposit has been created, the female mold is lifted off from the support structure or is swung out laterally. When producing structural elements with a lateral rim that extends steeply upward, it is possible that the fiber bundles that are deposited on the corresponding inner edge of the female mold are pushed together downwards when the male mold is introduced, and thus the desired distribution of the fiber bundles is disturbed. To avoid this effect, a performing tool 31 is preferably used, which precompacts and presses against the edge of the fiber bundles that are deposited at the upwardly extending inner edge, so that the deposit can no longer be pushed together downwards when the male mold 32 is put in place. A male mold is thereupon placed on the female mold, so as to compact the deposit to the desired final thickness and the desired shape. The female mold, the male mold, and the enclosed fiber deposit are then heated in a heatable press (not shown) under suitable pressure and at a suitable temperature, until the plastic material has polymerized and set.

Figure 3:
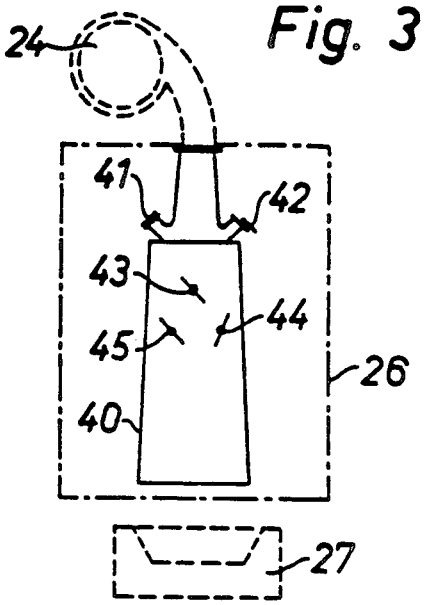
FIG. 3 shows a first embodiment of the tower used to deposit fiber flakes bonded with a synthetic resin bonding agent.

In a preferred embodiment of the method according to the present invention, a tower 40 is used, which has a plurality of guide surfaces (41, 42, 43, 44, 45) distributed at various heights and about its circumference, as is shown schematically in FIG. 3. These guide surfaces make it possible to steer the fiber bundles that are descending in the tower into certain directions, and in this way to create deposits with a different thickness depending on position. It is here understood that the guide surfaces are simply installed in fixed fashion to produce simple structural elements in large numbers, and are preferably disposed so as to be movable to produce structural elements with very strong relief-like shaping, so as to make possible a readjustment of the direction of the surfaces and therefore a correction of fabrication parameters.

Figure 4:
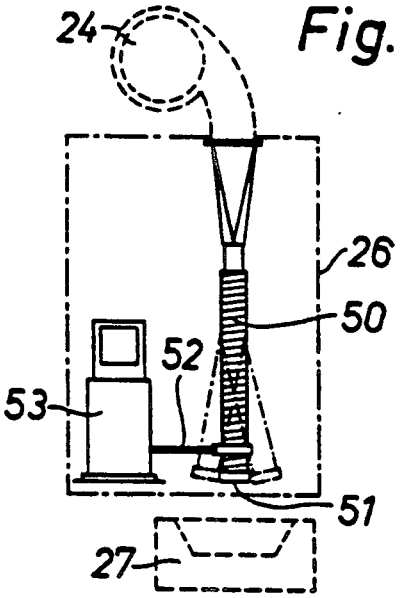
FIG. 4 shows a second embodiment of this tower.

In another embodiment of the method according to the present invention, the fiber bundles do not fall freely on the female mold over the entire cross section of the tower, but are led into a flexible tube 50 with a relatively narrow cross section, as is schematically shown in FIG. 4. To create deposits with a different layer thickness, the outlet opening 51 of this tube is movably connected to a guiding device 52, which conducts the outlet opening, with different speed, over the surface of the female mold that is provided for depositing the fiber bundles. For this purpose, the guiding device can be controlled by a control device 53. This control device can either be mechanical, for example equipped with cam wheels, or it can operate in an electronic-numerical fashion.

To create deposits with variable thickness, using a tower of the type described above, one can simply use a female mold with holes having a different diameter. Different amounts of air are then suctioned through these holes, in correspondence with their diameter. This results in the deposition of different quantities of fiber bundles.

To produce structural elements for the interior lining of automobiles, it is preferable to use, in the willow machine, textile fibers that are obtained from textile wastes, which contain no synthetic fibers or no more than 50% synthetic fibers. Proven fine-grained thermosettable resinous materials that are useful are, for example, Phenol-containing resins, Phenol-Formaldehyde resins, Cresol-Formaldehyde resins, Melamin-Formaldehyde resins, Vinyl polymers, Phenyl-Acrylate resins, Vinyl-Ester resins, Epoxy resins, and Polyurethanes based on Phenol-Formaldehyde resins are preferred. The weight ratio of the fiber material to the fine-grained material is about 2:1. The thickness of an average deposit on the female mold, before the male mold is put in place, for example amounts to 50–100 mm. After pressing and after the synthetic resin bonding agent has hardened, this deposit yields structural elements with thicknesses between 5 and 50 mm, and with an elastic modulus between 1 and 10 $N/cm^2$.

The pressing pressure as well as the temperature and time required for the polymerization of the synthetic resin bonding agent depend on the thickness of the deposit and on the type of synthetic resin bonding agent. Their correct choice lies within the domain of knowledge of a person skilled in the art and, for this reason, will not be discussed further here.

In still another embodiment of the method described above, the transport belt 19, which conducts the nonwoven fiber fabric from the carding machine to the through-type furnace 21, is loaded with a thin, nonwoven, textile composite material. This composite material, together with the nonwoven fabric lying on top, is conducted into the through-type furnace, and is here glued together with the nonwoven fabric. The composite material, together with the nonwoven fabric on top, is then opened in the willow machine. In this way, parts of the composite material are also deposited on the female mold, together with the fiber bundles, and finally form a portion of the structural element that is being produced.

The new method and the apparatus used to implement it make possible a previously unachievable uniformity of the mixture of fiber material and plastic adhesive. The use of a fine-grained and pre-polymerized bonding agent has an advantage as compared to a liquid bonding agent, namely that neither the adhesive nor the fibers or fiber bundles "wetted" by the adhesive remain stuck at the interior walls or edges of any device of the apparatus, and in particular that they do not plug up the holes in the female mold with their relatively small diameter. It has already been mentioned that the prepolymerization of the powdered synthetic resin bonding agent can avoid losses of bonding agent, especially in the tower, and, in the case of thermosettable hardening, in the hot-air stream.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A method for producing a formed structural element of fiber material bonded with synthetic resin comprising the steps:

sprinkling or spraying a fine-grained or flowable thermosetting synthetic resin bonding agent on a nonwoven fabric made of natural fibers, said resin bonding agent having a temperature at which said resin bonding agent is softened;

transporting said nonwoven fabric which is permeated with synthetic resin bonding agent to a location for fragmenting said fabric;

preheating said nonwoven fabric permeated with synthetic resin bonding agent to said temperature at which said thermosetting resin is softened, thereby gluing said fabric with said resin bonding agent prior to fragmenting said fabric;

fragmenting said nonwoven fabric which is permeated with prehardened synthetic bonding agent into fiber bundles, corresponding to flakes, of a size greater than individual fibers;

applying the fragmented fabric onto a perforated female mold of a molding press;

compressing the applied fabric on the female mold by means of an air stream suctioned through the perforations;

forming structural elements with a stable shape by placing a similarly perforated male mold on top and pressing, in the presence of a hot air stream that is conducted through the perforations in the male mold and the female mold; and hardening the synthetic resin bonding agent.

2. The method of claim 1, wherein, before the synthetic resin bonding agent is sprinkled on or sprayed on, the nonwoven fiber fabric is applied to a strip-shaped support that is formed of a nonwoven textile composite material, and wherein this support is joined to the nonwoven fabric while the synthetic resin bonding agent is being preheated, and is fragmented into flakes, together with the nonwoven fabric, and is deposited on the female mold, to form an integral part of the structural element.

3. The method of claim 1, wherein the flakes of the fragmented nonwoven fiber fabric are deposited on the female mold with a thickness that differs depending on position, to produce structural elements with regions of different thickness and with a material density that is uniform in all their regions.

4. The method of claim 1, wherein said fibrous material is formed into deposition regions of different thickness, said different thickness of the deposition regions is controlled in accordance with the desired throughflow resistance for air and in accordance with the desired elastic modulus, in order to produce structural elements with optimum sound absorption and insulation.

5. The method of claim 1, wherein said fabric is fragmented into flakes and when using a female mold having a strongly slanted border, the flakes deposited at the border are pressed against it before the male mold is placed on top.

* * * * *